US009125507B2

(12) United States Patent
Beachy

(10) Patent No.: US 9,125,507 B2
(45) Date of Patent: Sep. 8, 2015

(54) MAILBOX ALERT SYSTEM

(71) Applicant: Lloyd Beachy, Nappanee, IN (US)

(72) Inventor: Lloyd Beachy, Nappanee, IN (US)

( * ) Notice: Subject to any disclaimer, the term of this patent is extended or adjusted under 35 U.S.C. 154(b) by 0 days.

(21) Appl. No.: 14/332,455

(22) Filed: Jul. 16, 2014

(65) Prior Publication Data

US 2015/0021384 A1 Jan. 22, 2015

Related U.S. Application Data

(60) Provisional application No. 61/847,453, filed on Jul. 17, 2013.

(51) Int. Cl.
*A47G 29/122* (2006.01)

(52) U.S. Cl.
CPC ..... *A47G 29/121* (2013.01); *A47G 29/1225* (2013.01)

(58) Field of Classification Search
CPC . A47G 29/121; A47G 29/1225; A47G 29/30; A47G 2029/1225
USPC ..... 232/17, 34, 35, 45
See application file for complete search history.

(56) References Cited

U.S. PATENT DOCUMENTS

| | | | | | |
|---|---|---|---|---|---|
| 2,428,423 | A | * | 10/1947 | Hurban | 232/35 |
| 2,433,940 | A | * | 1/1948 | Weaver | 232/35 |
| 2,874,895 | A | * | 2/1959 | Opp et al. | 232/35 |
| 3,095,140 | A | * | 6/1963 | Buedingen | 232/35 |
| 3,338,511 | A | * | 8/1967 | Cvar | 232/35 |
| 3,516,383 | A | | 6/1970 | Goodman | |
| 3,596,631 | A | | 8/1971 | Sutton | |
| 3,620,443 | A | | 11/1971 | Sturtz et al. | |
| 3,866,823 | A | * | 2/1975 | Grayson | 232/35 |
| 4,000,847 | A | * | 1/1977 | Duis | 232/35 |
| 4,138,056 | A | * | 2/1979 | Sherrill | 232/35 |
| 4,171,086 | A | * | 10/1979 | Hudson | 232/35 |
| D271,476 | S | | 11/1983 | Gaudet, Sr. | |
| 4,473,182 | A | * | 9/1984 | Dion | 232/35 |
| 4,491,268 | A | | 1/1985 | Faulkingham | |
| 4,524,905 | A | * | 6/1985 | Crist | 232/35 |
| 4,702,411 | A | | 10/1987 | Yager | |
| 4,708,286 | A | | 11/1987 | Norris | |
| 4,711,391 | A | * | 12/1987 | Roge et al. | 232/35 |
| 4,712,732 | A | | 12/1987 | Esopi | |
| 4,728,028 | A | | 3/1988 | Barnes et al. | |
| 4,798,326 | A | * | 1/1989 | Kirry et al. | 232/34 |
| 4,805,834 | A | * | 2/1989 | Saba | 232/34 |
| 4,896,624 | A | | 1/1990 | Carnwath | |
| 5,076,337 | A | | 12/1991 | Reuter | |
| 5,082,170 | A | | 1/1992 | Goss | |
| 5,094,386 | A | * | 3/1992 | Tabacco | 232/35 |
| 5,123,590 | A | * | 6/1992 | Teele | 232/35 |
| 5,255,843 | A | | 10/1993 | Deakyne | |
| 5,366,148 | A | * | 11/1994 | Schreckengost | 232/35 |
| 5,482,206 | A | | 1/1996 | Waycasy | |
| 5,497,940 | A | * | 3/1996 | Vogt | 232/35 |

(Continued)

*Primary Examiner* — William Miller
(74) *Attorney, Agent, or Firm* — Thomas D. Webster; TDW Patents and Consulting

(57) ABSTRACT

A mail alert signaling device for use with a mailbox having a housing and door for receiving mail said device being attached at one of its ends to the exterior of the mailbox and having a signaling portion on the other end wherein an L-shaped member of the signaling portion reversibly couples with a lip portion on the mailbox to configure the device in standby mode, and when the door is opened die L-shaped member is dislodged from the lip portion thereby signaling mail delivery.

12 Claims, 4 Drawing Sheets

(56) References Cited

U.S. PATENT DOCUMENTS

| | | | | |
|---|---|---|---|---|
| 5,762,264 | A | 6/1998 | Ginsberg | |
| 5,816,489 | A | 10/1998 | Stockman | |
| 5,964,401 | A | 10/1999 | Thill | |
| 6,053,404 | A * | 4/2000 | Jefferson et al. | 232/35 |
| 6,575,357 | B1 | 6/2003 | Rundell | |
| 7,270,260 | B1 | 9/2007 | Powers | |
| 7,331,510 | B1 | 2/2008 | Brown | |
| 7,357,297 | B2 * | 4/2008 | Crowson | 232/35 |

* cited by examiner

MAILBOX ALERT SYSTEM

CROSS REFERENCE TO APPLICATIONS

This application claims the benefit of U.S. Provisional Application No. 61/847,453, filed Jul. 17, 2013, the entire contents of which is herein incorporated by reference.

FIELD OF THE INVENTION

The present invention relates to a device that signals that mail has been delivered to a standard rural mailbox.

BACKGROUND OF THE INVENTION

Mail delivery generally involves a postal employee delivering mail to a rural or suburban mailbox. While most if not all mailboxes are equipped with a flag that can be raised to signal to the postal employee that outgoing mail is present for pick-up, less common are devices to signal to tire home or property owner that mail has been delivered to the mall box. Without such a device, the addressee generally has to walk out to the mail box to check for delivery. When there has been no mail delivery, such trips can be inconvenient, and for some people—such as the elderly or handicapped—possibly over-taxing.

Mailboxes come in differing types and styles. Generally a standard roadside mailbox has an open housing or chamber with a hinged door at one end, placed near the road, with top, side, back, and bottom walls. One type of distinction in mailboxes relates to the presence or absence of a lip portion. On mailboxes that lack a lip portion the edge of the door is generally flanged such that when closed the door sits flush against the body of the mailbox. On the other hand, mailboxes that have a lip portion generally have a recessed space between the door and the front edge of the lip portion of the mailbox.

Prior mailbox signaling devices of various types are known, for example, U.S. Pat. No. 5,082,170; U.S. Pat. No. 4,702,411; U.S. Pat. No. 4,798,326; U.S. Pat. No. 3,866,823; U.S. Pat. No. 4,728,028. These and other devices presumably provide some degree of benefit as a mail delivery signaling device. However, prior devices are either complex in nature or designed to work only with a specific type of mailbox. Thus, there remains a need for a simpler mad alert device that is easy to install and use, is cost-effective, and can be adapted for use on different types of mailboxes.

SUMMARY Of THE INVENTION

The mailbox alert device and system of the present invention is a mechanical device that attaches to a typical roadside mailbox to signal when mail has been delivered. The design is simple and the device is compatible with different types of mailboxes.

The mailbox alert device of the invention, relates to an elongated member having a first end that is securely fastened to the mailbox and a second end that books or snaps over a stationary lip portion on a mailbox, the device being positioned in such a way that when the mailbox door is opened, the second end of the elongated member is pushed off the lip and settles into a relaxed position. The relaxed or signaling mode position provides a visual signal that the door has been opened and mail delivered.

For mailboxes lacking a lip portion, or having a lip that is improperly spaced or configured to operatively interact with the device of the invention, the present invention further includes a multi-purpose bracket that enables use of the device on additional mailbox, types. The multi-purpose bracket can be used in at least two different ways depending on the type of mailbox. If the mailbox does not already have a lip, the bracket cars be mounted to the mailbox to provide a suitable lip portion, if the lip of a mailbox is too far away from the mailbox door to trigger the device when the door opens, the multi-purpose bracket can be attached to the door to extend the door's reach.

In one aspect, the present invention relates to a mailbox alert device.

In another aspect, the invention relates to a mailbox alert device having a flexible elongated member, one end of which securely attaches to the mailbox, and the other end having a member that, enables reversible coupling of the device to a lip portion of the mailbox, said lip portion being integral to the mailbox or retrofitted thereto.

In another aspect, the invention relates to a mailbox alert device having a flexible elongated member, one end of which is securely attached to the mailbox, the other end having a member that enables reversible coupling of the device to a lip portion, of the mailbox, said lip portion being integral to the mailbox or retrofitted thereto, said device further comprising a multi-purpose bracket for use in providing a mailbox with an appropriately configured lip portion for interaction with the elongated member.

In another aspect, the invention relates to a mailbox in combination with an alert device of the present invention wherein the mailbox is already equipped with a suitably configured lip portion.

In another aspect, the invention relates to a mailbox in combination with an alert device of the present invention wherein the mailbox, not having a suitably configured lip portion, is fitted with a multi-purpose bracket according to the invention to enable use of the device.

In another aspect, the present invention relates to a kit containing one or more component parts of a mailbox alert device of the invention including, but not limited to, an elongated member, multi-purpose bracket, and attachment means such as screws or rivets for scouring the device to a mailbox.

It is an object of the present invention to provide a mailbox alert device and system that can be used on most mailbox types to provide a visual signal when mail has been delivered to the box.

These and other objects and advantages of the present invention will be apparent from the following description, the accompanying drawings, and the appended claims. This Summary is provided merely to introduce certain concepts and not to identify any key or essential features of the claimed subject matter.

BRIEF DESCRIPTION OF THE DRAWINGS

The drawings provided herein form a part of the specification and are to be construed in conjunction therewith. Like reference numbers have been employed throughout wherever possible to indicted like or similar parts in tire various views and embodiments.

FIG. 22(*b*) provides a side view of the multi-purpose bracket of FIG. 22(*a*).

DETAILED DESCRIPTION OF PREFERRED EMBODIMENTS

Figure 1:
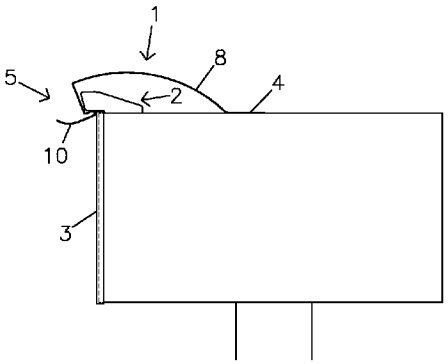
FIG. 1 provides a side view of an embodiment of a device of the invention attached to a mailbox that does not have an existing lip but which has been retrofitted with a multi-purpose bracket.

As used herein, the term "standby mode" refers to a ready position in which a device of the invention is set by reversibly engaging the free end of the device with the mailbox lip or multipurpose bracket such that when the door of the mailbox is opened, the device decouples from the lip or multi-purpose bracket to provide a signal that mail has been delivered.

As used herein, the term "signaling mode" refers to the relaxed position of the device after it has been triggered by opening the mailbox door, thereby providing a signal that mail has been delivered.

The term 'multi-purpose bracket" is used herein to describe an optional additional component to a device of the invention that enables the device to operate on additional mailbox types whether they are equipped with a lip portion or not. One aspect of the multi-purpose bracket functions essentially like a lip portion that can be retrofitted (i.e. "retrofit lip") to a mailbox that does not already lame a properly configured and spaced lip portion to enable cooperative interaction with an alert device of the invention. Another aspect of the multi-function bracket is to provide an extension of the reach of a mailbox door.

The mailbox alert device and system of the present invention is intended for use on a typical roadside mailbox to signal when mail has been delivered. The specific action that causes the signaling apparatus to deploy is opening the mailbox door after the device has been set in standby mode. In the broadest sense, the present invention gives a visual signal that allows a person to determine from a remote location whether or not mail has been delivered to the mailbox.

Mailboxes come in a variety of shapes, sizes, and styles. Generally, all mailboxes have an open housing chamber for receiving mail, a door at the front end facing the road, the door being hinged to the bottom for opening and closing, the box further having top, side, back, and bottom walls. One distinction, however, in types of mailboxes relates to whether or not the box includes a lip portion. When present, the lip con be is generally located at the front end of the box, protruding out there from toward the road. On mailboxes that lack such a lip the edge of the door is generally flanged such that when the door is closed it sits flush against the front edge of the mailbox. In contrast, mailboxes that have a protruding lip portion generally have a recessed space between the door and the front edge of the lip portion of the mailbox.

A device of the invention can be mounted to most mailbox types including those with lip portions and those without lip portions. The device includes a flexible elongated member having two ends, one of which is secured to the top or sides of a mailbox, the other end providing a signaling portion that is capable of reversibly interacting with a suitable lip member that is either integral to the mailbox or has been provided by the attachment of a multi-purpose bracket (i.e., retrofitted).

There are two main pans to a device of the invention, an elongated member and a multi-purpose bracket. The multi-purpose bracket is optional and only needed in cases where the mailbox either is not equipped with a lip portion, or has a lip portion that does not provide the necessary configuration for cooperative interaction with the signal portion of the elongated member when the mailbox door is opened.

A device of the invention can be made from any suitable material as would generally be known to the skilled artisan. The elongated member of a device of the invention is preferably made out of a flexible material that will allow it to return to its original form after being in the bent state, or standby position, for extended periods of time. It is also desirable that the device be capable of retaining its original form over extreme temperature ranges that exist in various climates. For the elongated member it is desirable that the material accommodate bending of the device without breakage when in the standby mode, wherein spring tension is imparted to the device that allows the member to return to its original shape when tension is released after the mailbox door has been opened. Suitable materials for fabricating a device of the invention include metals or plastics.

FIGS. 1-22 will be discussed hereinbelow to illustrate certain preferred embodiments of the invention. It should be understood, however, that the invention is not limited to the precise forms of the preferred embodiment(s), apparatus, device, or material as disclosed hereinbelow, and that changes, may be made therein without departing from the scope of the invention.

Figure 9:
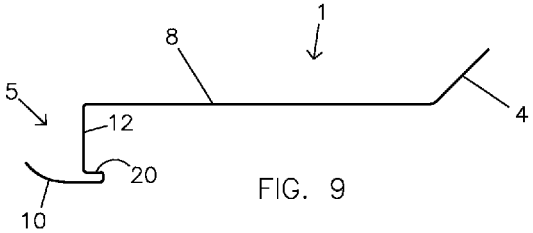
FIG. 9 provides a side view of the device of FIG. 1 without the multi-purpose bracket.
Figure 14:
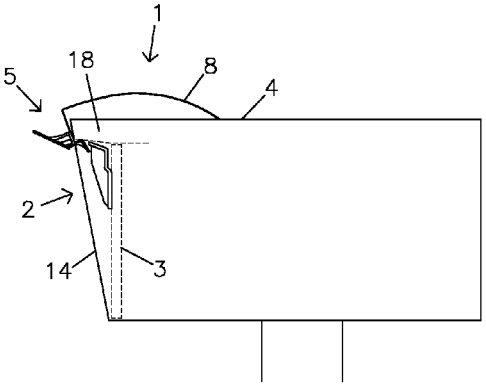
FIG. 14 shows a side view of the device of FIG. 12 mounted to a mailbox having a lip portion that is too deep to cooperatively interact with the device and showing a multi-purpose bracket attached to the top region of the door to enable cooperative interaction of the door with the device to signal mail delivery.
Figure 19:
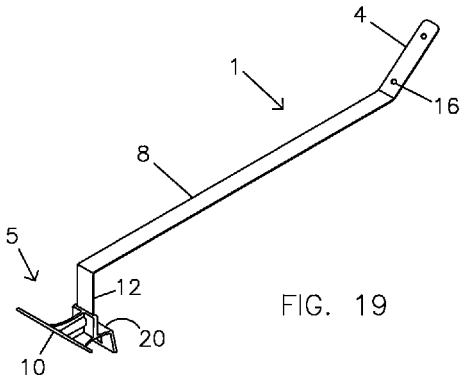
FIG. 19 provides an isometric view of the device of FIG. 12 without the multi-purpose bracket.

Referring now to FIG. 9 and FIG. 14, a device of the invention can be mounted to the top or to either side of a mailbox. The overall length of a device of the invention, as measured from the mounting portion 4 to the signaling portion 5, is from about 8 inches to about 14 inches; preferably about 12 inches. The device has a small flat mounting portion 4 for attachment of the device to the outside of the mailbox. Any suitable attachment method could be used to secure the device to a mailbox including screws, bolts, and/or double-sided tape. As depicted in FIG. 19, the mounting portion may include mounting holes 16 to accommodate attachment with screws or bolts. The end opposite mounting portion 4 includes the signaling portion 5 that includes a handle member 10 and an L-shaped member 12. The signaling portion 5 is configured to keep the device in the bent or standby mode when attached to a suitable lip portion on the mailbox. A device of the invention is set in standby mode by pulling the signaling portion 5 forward and downward while hooking it over a stationary lip on the mailbox. In standby mode, the signaling portion of the device is positioned in such a way that when the mailbox door is opened, the door will make contact with the signaling portion 5 and push it off the lip (See FIG. 7). This action causes the device to go back to its relaxed, or signaling mode, that indicates the door has been opened and mad delivered.

Figure 2:
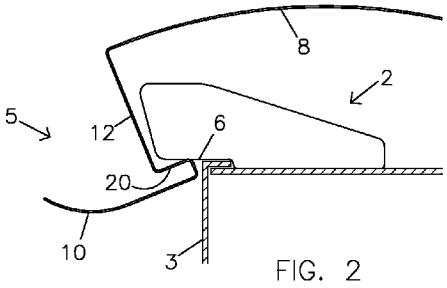
FIG. 2 provides a closer perspective view of the interaction of the device of FIG. 1 with a multipurpose bracket mounted to a mailbox.
Figure 3:
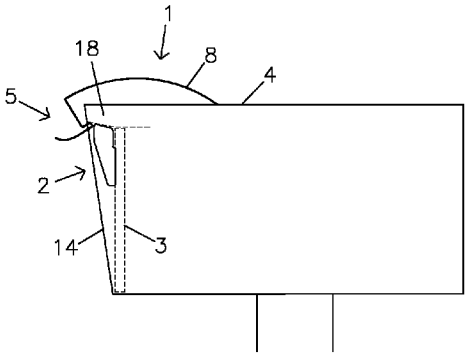
FIG. 3 provides a side view of the device of FIG. 1 configured for a mailbox that has an existing lip but the door is too remote from the lip edge to make contact with the device when the door is opened. A multi-purpose bracket of the invention is mounted to the door to extend the door's reach.
Figure 4:
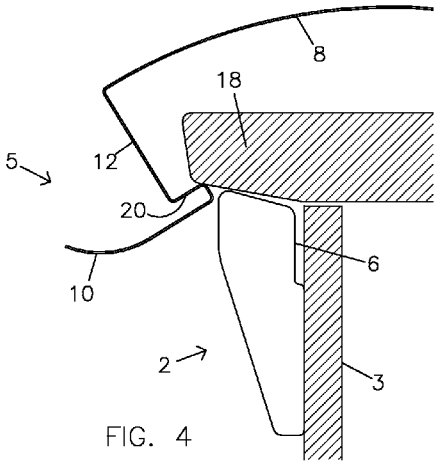
FIG. 4 provides a closer perspective view of the device of FIG. 3.
Figure 5:
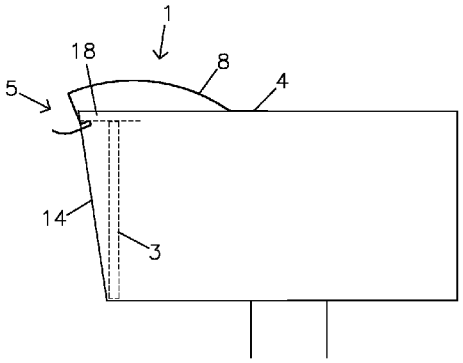
FIG. 5 provides a side view showing the elongated member of the device of FIG. 1 attached to a mailbox that has an existing lip that operatively interacts with the signaling portion of the device and does not require the use of a multi-purpose bracket.

Referring now to FIGS. 1-9, one embodiment of a device 1 of the invention includes a mounting portion 4, an elongated member 8, and a signaling portion 5. As shown in FIG. 1, the device 1 can be mounted to the top portion or side portion (not shown) of a mailbox by securing the mounting portion 4 of device 1 to the mid to rear section of the mailbox. FIG. 1 illustrates attachment of device 1 to a mailbox lacking a lip member. FIG. 3 shows device 1 attached to a mailbox having a lip member 18 that is inappropriately configured such that attachment of a multi-purpose bracket 2 is needed to permit operative interaction between door 3 and signaling portion 5. FIG. 5 shows attachment of device 1 to a mailbox having a lip member 18 that is operatively configured to permit interaction with signaling portion 5 without use of a multi-purpose bracket 2.

Elongated member 8 is bent when placing device 1 in the standby position (FIG. 1). Bending elongated member 8 and then attaching signal portion 5 to a mailbox lip portion 18 or to multi-purpose bracket 2 imparts spring tension to the device in the ready position to be tripped by contact with the mailbox door 3 when the door is opened.

Figure 10:
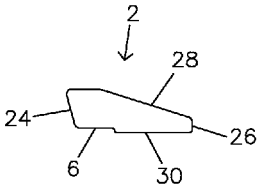
FIG. 10 provides a side new of an embodiment of a multi-purpose bracket of the invention.
Figure 11:
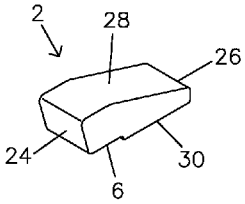
FIG. 11 provides an isometric view of the multi-purpose bracket of FIG. 10.

A device of the invention can be configured in several different ways depending on the type of mailbox being used. Each of these configurations may or may not require use of the multi-purpose bracket 2 (FIGS. 10 & 11).

FIGS. 1 and 2 show device 1 configured for a mailbox that does not already have a lip for the signal portion 5 to hook on to. For this configuration, multi-purpose bracket 2 is attached to the mailbox in such a way that it provides a suitable lip portion. This type of mailbox door 3 is one that closes by overlapping on the outside of the mailbox body (FIG. 2). The multi-purpose bracket 2 is notched to provide a clearance space 6 where the door overlaps the mailbox body. When the mailbox door 3 is opened, the door makes contact with the signaling portion 5 causing device 1 to go back to its relaxed or signaling mode.

FIGS. 3 and 4 show device 1 configured for a mailbox that has a lip for the signaling portion 5 to hook on to, but the lip is positioned too far away to make contact with the mailbox doer 3 as it is being opened. For this configuration, the multi-purpose bracket 2 is attached to the mailbox door 3 for the purpose of extending the door's reach so it will make comma with the signaling portion 5 as the door is opened. This contact causes signaling portion 5 to be released and device 1 to go back to its relaxed or signaling mode.

Figure 6:
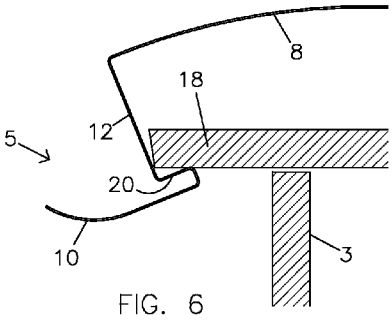
FIG. 6 provides a closer perspective view of the device of FIG. 5 and the interaction of the signaling portion with the lip.

FIGS. 5 and 6 show device 1 configured for a mailbox that has an appropriately-configured lip for signaling portion 5 to hook on to and does not require use of the multi-purpose bracket. For this type of mailbox, the lip is positioned in such a way that the mailbox door 3 makes contact with the signaling portion 5 as it is being opened. This contact causes device 1 to go back to its relaxed or signaling mode.

Figure 7:
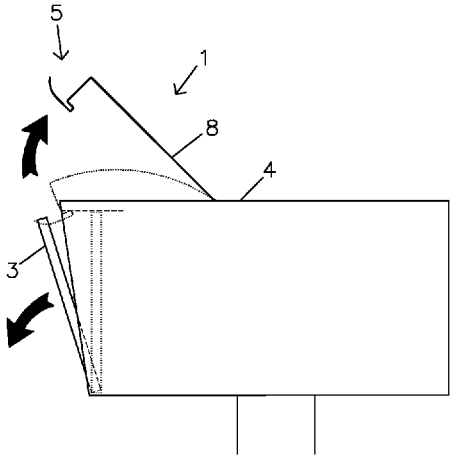
FIG. 7 provides a side view of the device as configured in FIG. 5 after the door has beers opened and the device deployed to signal mail delivery.

FIG. 7 illustrates how device 1 goes back to its relaxed or signaling mode when the mailbox door 3 is opened. While FIG. 7 shows one configuration of the Mailbox Alert System of the invention, this action is the same for each of the other configurations as well.

Figure 8:
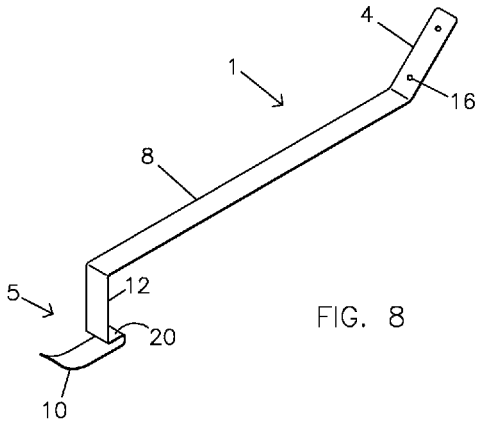
FIG. 8 provides an isometric view of the device of FIG. 1 without the multi-purpose bracket.

FIGS. 8 and 9 show an isometric aid side view, respectively, of this first embodiment of device 1.

FIGS. 10 and 11 show a side view and an isometric view, respectively, of multi-purpose bracket 2.

The embodiment of device 1 depicted in FIGS. 1-9 includes a signaling portion 5 that has a handle member 10 and an L-shaped portion having a long arm 12 and a short arm 20. One end of long arm 12 of the L-shaped portion is an extension of elongated member 8, that has been bent to an approximately perpendicular angle thereto. At the other end of long arm 12, short arm 20 projects away from long arm 12 back toward the mounting portion 4 of the device at an approximately normal angle thereto. The L-shaped portion provides a hook that can be secured onto the lip portion or multi-purpose bracket 2 when setting the device in standby mode. In this embodiment, handle member 10 is an extension of short arm 20 formed by looping back short arm 20 to form a convenient handle for ease in setting device 1 in standby mode.

The illustrations provided herein show device 1 mounted on top of the mailbox. However, other mounting positions can also be used. Depending on the type of mailbox, device 1 could also be mounted on the side of the mailbox, or even, half way between the side and the top. Any mounting position can be used so long as the door makes contact with the signaling portion 5 as the door is being opened.

Figure 12:
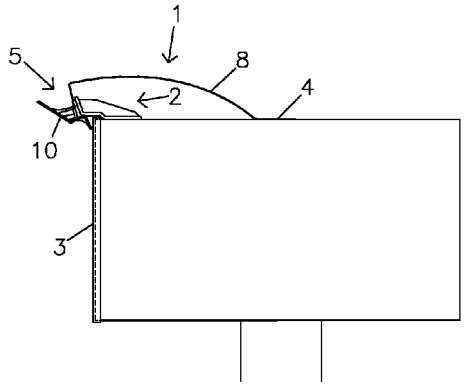
FIG. 12 provides a side view of another embodiment of a device of the invention attached to a mailbox in standby position including a multi-purpose bracket mounted on top of the mailbox showing the cooperative interaction between the signaling portion of the device with the multi-purpose bracket.
Figure 15:
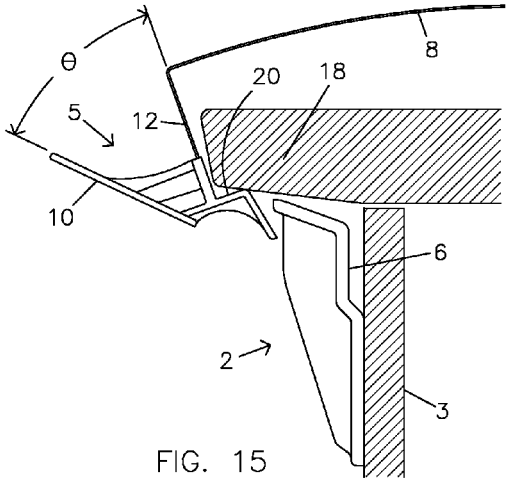
FIG. 15 provides a closer view of the device of FIG. 14 showing the signaling portion of the device booked over the lip of the mailbox and the proximity of the multi-purpose bracket mounted to the top of the door to enable contact between the door and the signaling portion.
Figure 16:
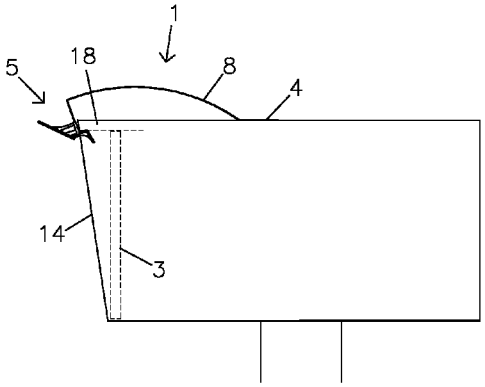
FIG. 16 provides a side view of the device of FIG. 12 mounted to a mailbox having a lip that is properly spaced irons the signaling portion of the device such that no multi-purpose bracket is required.

Referring now to FIGS. 12-22, a second preferred embodiment of device 1 of the invention shall now be described. Device 1 includes a mounting portion 4, an elongated member 8, and a signaling portion 5. As shown in FIG. 12, device 1 can be mounted to the top portion or side portion (not shown) of a mailbox by securing the mounting portion 4 of device 1 to the mid to rear section of the mailbox FIG. 12 illustrates attachment of device 1 to a mailbox lacking a lip member. FIG. 14 shows device 1 attached to a mailbox having a lip member 18 that is incorrectly configured such that attachment of a multi-purpose bracket 2 is needed to permit operative interaction between door 3 and signaling portion 5. FIG. 16 shows attachment of device 1 to a mailbox having a lip member 18 that is correctly configured to permit interaction between door 3 and signaling portion 5 without use of a multi-purpose bracket 2.

Elongated member 8 is bent when placing device 1 in the standby position. Bending elongated member 8 and then attaching signal portion 5 to a mailbox lip portion 18, or to multi-purpose bracket 2, imparts spring tension, to the device in the ready or standby position to be tripped by contact with mailbox door 3 when the door is opened.

This embodiment of device 1 can be configured in several different ways depending on the type of mailbox being used. Each of these configurations may or may not require use of the multi-purpose bracket 2.

Figure 13:
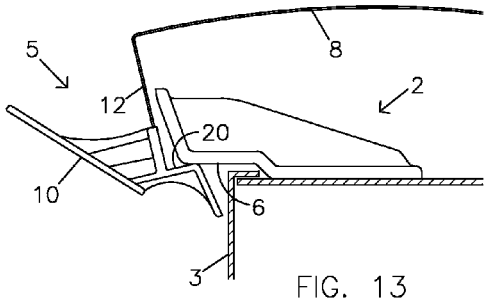
FIG. 13 shows a closer perspective view of the device of FIG. 12 and the interaction of the signaling portion with the multi-purpose bracket.

FIGS. 12 and 13 show device 1 configured for a mailbox that does not already have a lip for the signal portion 5 to hook on to. For this configuration, multi-purpose bracket 2 is attached to the top of the mailbox in such a way that it provides a suitable lip member. This type of mailbox door 3 closes by overlapping on the outside of the mailbox body (FIG. 13). Multi-purpose bracket 2 is notched to provide a clearance space 6 where the door overlaps the mailbox body (FIG. 13). When mailbox door 3 is opened, it makes contact with the signaling portion 5 causing device 1 to go back to its relaxed or signaling mode.

FIGS. 14 and 15 show device 1 configured for a mailbox that has a lip for the signaling portion 5 to hook on to, but the lip is positioned too far away to make contact with the mailbox door 3 as it is being opened. For this configuration, the multi-purpose bracket 2 is attached to the mailbox door 3 for the purpose of extending the door's reach so it will make contact with the signaling portion 5 as the door is opened. This contact causes signaling portion 5 to be released and device 1 to go back to its relaxed or signaling mode.

Figure 17:
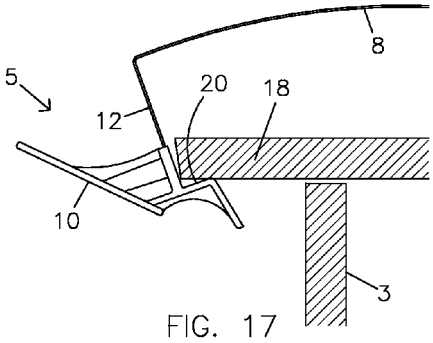
FIG. 17 provides a close-up view of the device and mailbox depicted in FIG. 16.

FIGS. 16 and 17 show device 1 configured for a mailbox that has a lip for signaling portion 5 to hook on to and does not require use of the multi-purpose bracket. For this type of mailbox, the lip is positioned in such a way that the mailbox door 3 makes contact with the signaling portion 5 as it is being opened. This contact causes device 1 to go back to its relaxed or signaling mode.

Figure 18:
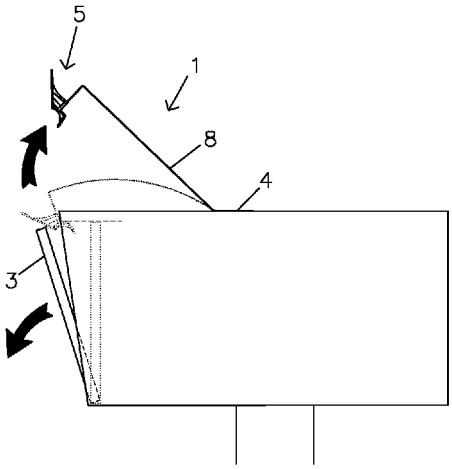
FIG. 18 provides a side new of a device of FIG. 12 in the deployed or signaling mode, after the mailbox door has been opened.

FIG. 18 illustrates how device 1 goes back to its relaxed or signaling mode when the mailbox door 3 is opened. FIG. 18 shows one configuration of the device and alert system of the invention. However, the action depicted is the same for each of the other configurations as well.

Figure 20:
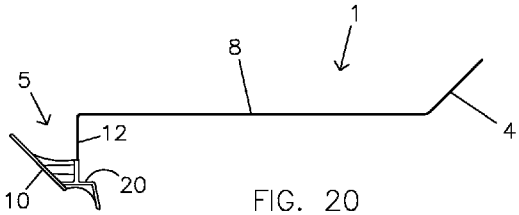
FIG. 20 provides a side view of the device of FIG. 12 without the multi-purpose bracket.
Figure 21:
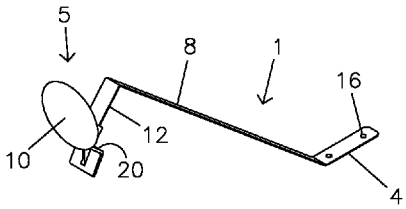
FIG. 21 provides an alternative perspective view of the device of FIG. 12.

FIGS. 19-21 show a side view and isometric views of this second embodiment of device 1.

Figure 22A:
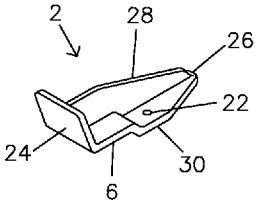
FIG. 22(*a*) shows an isometric view of the multi-purpose bracket of the invention.
Figure 22B:
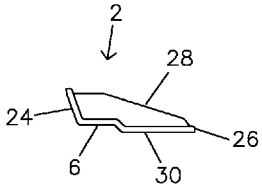

FIGS. 22(*a*) and 22(*b*) show a side view and an isometric view of multi-purpose bracket 2.

As with the first embodiment described supra, this second embodiment of device 1 includes a signaling portion 5 that has a handle member 10 and an L-shaped portion having a long arm 12 and a short arm 20, said short arm 20 for contacting the lip portion 18 or multi-purpose bracket 2. One end of bag arm 12 of the L-shaped portion is an extension of elongated member 8, that has been bent to an approximately perpendicular angle thereto. At the other end of long arm 12, short arm 20 projects sway from long arm 12 toward the mounting portion 4 of device 1 at an approximately normal angle thereto. The L-shaped portion provides a hook that can be latched onto the lip portion 18 or multi-purpose bracket 2 when setting the device in standby position. Referring now to FIG. 15, handle member 10 in this embodiment extends away from short arm 20 such that any desired angle θ can be formed between the long arm 12 and the handle member 10, for example, between 0° to 180°; alternatively from 30° to 120°, alternatively still from 45° to 90° there from; preferably angle θ is about 45°. As depicted in FIG. 21, handle member 10 provides a round, flat surface or face, though other shapes could also be used such as square, rectangular triangular, hexagonal, polygonal etc. Handle member 10 provides an easy grip when setting the device. Handle member 10 also provides a readily visible signal when the device has been tripped in deployed mode. For this purpose, handle 10 can be partially or completely coated, with a material that provides a colored or fluorescent surface to improve visibility, for example, by painting the surface of handle 10 any color desired, or by attaching colored fluorescent stickers or labels.

Referring now to FIGS. 10-11 and 22, multi-purpose bracket 2 will now be described. The overall length of the multi-purpose bracket 2 is approximately 2 inches to 5 inches, preferably about 3.5 Inches. The multi-purpose bracket. 2 has a front end 24, a near end 26, atop surface 28 and a bottom surface 30. Bottom surface 30 includes a space 6 that allows a mailbox door to fully close when bracket 2 is mounted to the top of the mailbox (See FIGS. 1 and 12). In one aspect, multi-purpose bracket 2 can provide an operative lip portion for reversible coupling with a device of the invention on a mailbox not already having properly configured Hp portion (See e.g. FIG. 2). In this use, the bracket provides a region on the mailbox over which a device of the invention can be reversibly attached in another aspect, multi-purpose bracket 2 is mounted to the door of a mailbox that has a lip portion but the lip portion is configured such that the door will not make contact with the device of the invention when opened. In this aspect, the bracket 2 is mounted to the door, for example near tire top thereof to extend the reach of the door when opened (See e.g. FIG. 4). The multi-purpose bracket can be attached by any suitable means known to the skilled artisan such as screws, bolts, and/or double-sided tape. For this purpose, multi-purpose bracket 2 includes a hole 22 that can receive such attachment means for mounting to a mailbox.

In use, a device of the invention is set by bending the elongated portion of the device such that the L-shaped region of the signal portion is hooked over the mailbox lip or over an installed multi-purpose bracket to reversibly couple therewith. This action to set the device in standby mode produces an arc in the elongated portion adding spring tension to the device. When set in this fashion, the device can be dislodged when the mailbox door is opened to insert mall into the mailbox. As depicted in FIG. 18, for example, when the door is opened, the signal portion of the device is dislodged and the device springs back to a relaxed state in which the device is pointing in a generally upward direction thereby providing a visible signal that the door has been opened.

In other aspects, the present invention relates to a device of the invention in combination with a mailbox. In another aspect the present invention relates to a kit comprising any one or more of a device of the invention and/or a multi-purpose bracket of the invention.

While certain preferred embodiments of the device and mailbox alert system of the present invention have been described, it should be understood that the invention is not limited to the precise form of apparatus or device or material, and that changes may be made therein without departing from the scope of the invention.

What is claimed is:

1. A mailbox alert device that provides a visual signal when mail has been delivered to a mailbox, said mailbox having a bottom panel and a top and sidewall structure defining an enclosure having a frontal opening, a door being hingedly attached to the bottom panel, said device comprising:

(a) an elongated portion having top and bottom surfaces, a first end having a portion that can be attached to a top or sidewall of the mailbox, and a second end having a signaling member comprising an L-shaped member that is capable of reversibly coupling with a lip portion on said mailbox;

(b) wherein said device is set in standby mode by bending the elongated member to form an arc therein and latching said L-shaped member over said lip portion, thereby imparting spring tension to said device;

(c) wherein when the mailbox door is opened to receive mail, said L-shaped member is dislodged from said lip portion, releasing said spring tension, thereby returning the device to a relaxed position, signaling mail delivery; and (d) wherein the L-shaped member of said signaling portion has a long arm that projects perpendicularly away from the bottom surface of said elongated member, and a short arm that projects perpendicularly away from said long arm, toward said first end of the elongated member.

2. A device as in claim 1 wherein said short arm is further configured to fold back on itself thereby forming a handle portion at the second end of said device.

3. A device as in claim 1 wherein said L-shaped member further comprises a handle portion having a planar face that extends away from the long arm of said L-shaped member at an angle of from 10° to 180°.

4. A device as in claim 3 wherein said planar face has a shape selected from circular, triangular, square, rectangular, or hexagonal.

5. A device as in claim 4 wherein said face of said handle portion is at least partially coated with a colored or fluorescent material.

6. A mailbox alert device that provides a visual signal when mail has been delivered to a mailbox, said mailbox having a bottom panel and a top and sidewall structure defining an enclosure having a frontal opening, a door hingedly attached to the bottom panel, said device comprising:

(a) an elongated portion having top and bottom surfaces, a first end having a portion that can be attached to a top or sidewall of the mailbox, and a second end having a signaling member comprising an L-shaped member that is capable of reversibly coupling with a lip portion on said mailbox;

(b) a multi-purpose bracket that provides said lip portion on said mailbox;

(c) wherein said device is set in standby mode by bending the elongated member to form an arc therein and latching said L-shaped member over said lip portion, thereby imparting spring tension to said device; and (c) wherein when the mailbox door is opened to receive mail, said L-shaped member is dislodged from said lip portion, releasing said spring tension, thereby returning the device to a relaxed position, signaling mail delivery.

7. A device as in claim 6 wherein the L-shaped member of said signaling portion has a long arm that projects perpendicularly away from the bottom surface of said elongated member, and a short arm that projects perpendicularly away from said long arm, toward said first end of the elongated member.

8. A device as in claim 7 wherein said short arm is further configured to fold back on itself thereby forming a handle portion at the second end of said device.

9. A device as in claim 7 wherein said L-shaped member further comprises a handle portion having a planar face that extends away from the long arm of said L-shaped member at an angle of from 10° to 180°.

10. A device as in claim 9 wherein said planar face has a shape selected from circular, triangular, square, rectangular, or hexagonal.

11. A device as in claim 10 wherein said face of said handle portion is at least partially coated with a colored or fluorescent material.

12. A kit comprising said device of claim 6.

* * * * *